US007441432B2

(12) United States Patent
Ingvarsson

(10) Patent No.: US 7,441,432 B2
(45) Date of Patent: Oct. 28, 2008

(54) METHOD AND A PRODUCTION LINE FOR MANUFACTURING A PRODUCT BY HYDROFORMING

(75) Inventor: Lars Ingvarsson, Borlange (SE)

(73) Assignee: Ortic 3D AB, Borlange (SE)

( * ) Notice: Subject to any disclaimer, the term of this patent is extended or adjusted under 35 U.S.C. 154(b) by 0 days.

(21) Appl. No.: 11/795,722

(22) PCT Filed: Feb. 1, 2006

(86) PCT No.: PCT/SE2006/000151

§ 371 (c)(1),
(2), (4) Date: Jul. 20, 2007

(87) PCT Pub. No.: WO2006/085811

PCT Pub. Date: Aug. 17, 2006

(65) Prior Publication Data

US 2008/0110222 A1 May 15, 2008

(30) Foreign Application Priority Data

Feb. 8, 2005 (SE) ..... 0500298

(51) Int. Cl.
*B21D 26/02* (2006.01)
*F16L 17/00* (2006.01)

(52) U.S. Cl. ..... 72/62; 72/58; 72/60; 72/370.22

(58) Field of Classification Search ..... 72/55, 72/57, 58, 61, 62, 368, 370.22; 29/421.1
See application file for complete search history.

(56) References Cited

U.S. PATENT DOCUMENTS

| | | | | |
|---|---|---|---|---|
| 3,613,423 | A | 10/1971 | Nakamura | |
| 6,000,271 | A | 12/1999 | Olsson et al. | |
| 6,502,822 | B1 | 1/2003 | Brown | |
| 6,609,301 | B1 * | 8/2003 | Morris et al. | 29/421.1 |
| 7,249,481 | B1 * | 7/2007 | Lowe | 72/62 |
| 7,254,977 | B2 * | 8/2007 | Machrowicz et al. | 72/342.3 |

FOREIGN PATENT DOCUMENTS

WO 0027563 5/2000

OTHER PUBLICATIONS

File EPODOC/EPO, Kawasaki Steel Corp: "Welding steel pipe superior in workability and manufacture thereof" JP 2000343135 A, 20001212.

* cited by examiner

*Primary Examiner*—David B Jones
(74) *Attorney, Agent, or Firm*—Mark P. Stone

(57) ABSTRACT

A production line for the manufacture of a product through hydroforming, having a decoiler (11) for unrolling a steel strip (12) from a coil (13), a roll-forming unit (14) for folding the steel strip into a tube (16), a welding unit (17) for welding together the edges of the steel strip, a hydroforming unit (18) having an openable mold (19, 20) to receive the completed tube as the tube is being formed and welded, a cutting arrangement (24, 25) for cutting off the completed product (23) that has been removed from the hydroforming unit, sealing arrangements (30, 33; 35-39) at two ends of the mold for sealing the tube, and a line (38) for the supply of pressure medium through one of the sealing arrangements for placing the tube under pressure. A method for manufacturing a product in such a line is also provided.

4 Claims, 2 Drawing Sheets

METHOD AND A PRODUCTION LINE FOR MANUFACTURING A PRODUCT BY HYDROFORMING

TECHNICAL AREA

The invention relates to a method and a production line for manufacturing a product through hydroforming.

THE PRIOR ART

During conventional hydroforming, a single tube-formed blank is placed into a mould and placed under pressure such that it is shaped hydrostatically in contact with the mould. The mould is opened, and the product is removed and replaced by a new blank.

AIMS OF THE INVENTION

The aims of the invention are to simplify and reduce the costs of the manufacture of hydroformed products, and to make possible complete automation of the manufacture.

BRIEF DESCRIPTION OF THE INVENTION

The aims described above are achieved in principle by the following consecutive operations: unrolling a strip from a coil and shaping the strip directly into a tube that is welded together and introduced into a mould for hydroforming, which is then held open such that previously shaped product can be removed, stopping the feed of the tape when the previously shaped product has been removed, closing the mould, sealing both ends of the tube and placing the tube under pressure such that it is shaped into a product, opening the mould, recommencing the manufacture of the tube, stopping the feed, cutting away the completed product, and hydroforming a new product.

A production line according to the invention comprises an decoiler for the unrolling of a steel strip from a coil, a roll-forming unit for folding the steel strip into a tube, a welding unit for welding together the edges of the steel strip, a hydroforming unit comprising a mould that can be opened for receiving the finished tube when the tube has been shaped and welded, a cutting arrangement for cutting the completed product after it has been removed from the hydroforming unit, arrangements at the two ends of the tube for sealing the tube, and a supply line for pressure medium through one of the sealing arrangements in order to place the tube under pressure.

DESCRIPTION OF PREFERRED AND ILLUSTRATED EMBODIMENT

Figure 1:
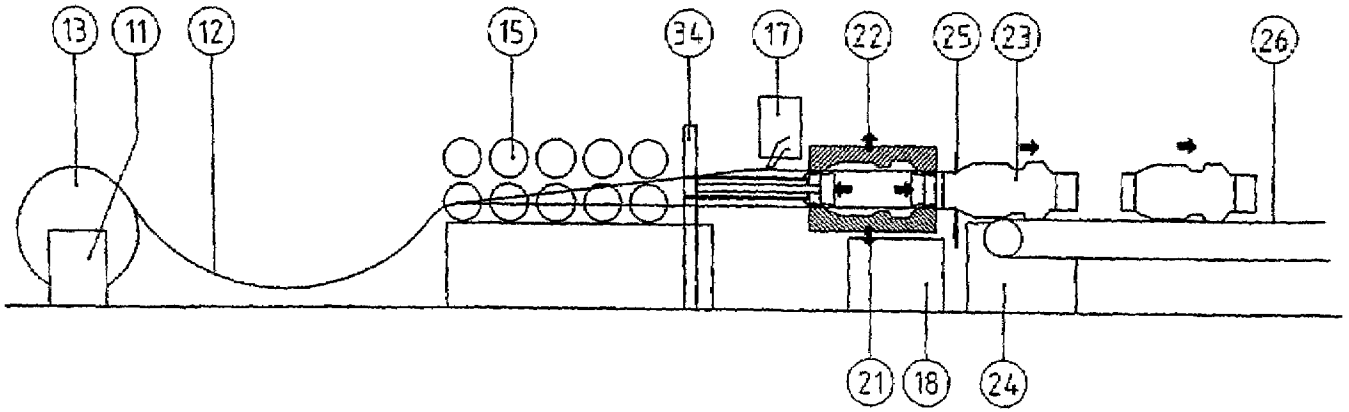
FIG. 1 shows schematically and seen from the side a production line according to the invention.

The drawings show a decoiler 11 for unrolling a steel strip 12 from a coil 13. The strip is led through a roll-forming unit 14 with shaping rollers 15, shown schematically. The strip is folded successively in the roll-forming unit to a tube 16, the longitudinal seam of which is welded together by a welding unit 17 when the tube passes the stationary welding unit. The tube may have a circular cross-section as shown. The roll-forming unit constitutes also the feed arrangement for the steel strip.

A hydroforming unit 18, shown schematically, is located after the welding unit. The hydroforming unit has a mould that consists of two moulding parts, an upper part 19 and a lower part 20. The mould is shown closed in FIG. 1 and it can be opened by machine power through the lower part being displaced downwards as is shown by the arrow 21 and the upper part being displaced upwards as is shown by the arrow 22 in FIG. 3. The mould parts are not shown in FIG. 2, but their inner shape is indicated.

When the tube 16 has been formed, the mould 19, 20 is held open such that the product 23 formed in the preceding manufacturing cycle can be removed from the mould while at the same time the tube 16 is continuously fed into the mould as it is being manufactured.

Figure 2:
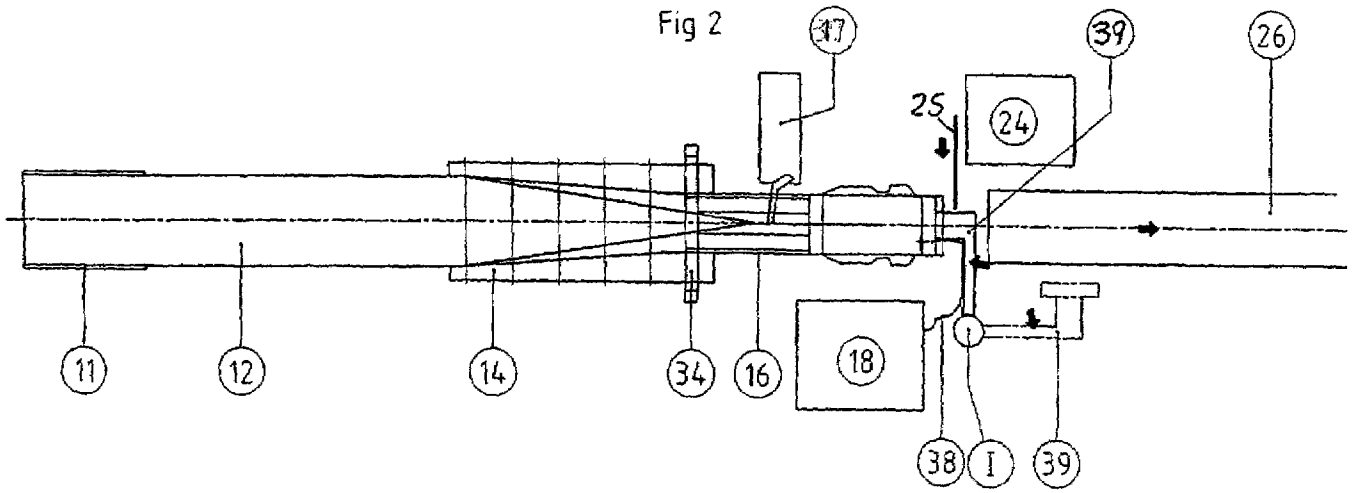
FIG. 2 shows the same production line seen from above.

When the product 23 that has been hydroformed is removed from the mould 19, 20, as is shown in FIG. 1, the manufacture of the tube is stopped and the tube 16 is cut by a cutting unit 24 that comprises a circular saw blade 25. The product 23 is subsequently taken away on a output unit 26, when it has been cut off. When the product 23 has been removed from the mould, the mould can be closed around the tube 16 as is shown in FIG. 1 and the tube inside the mould can be hydroformed. The product 23 is shown in FIG. 1 before it has been cut away, while it is shown in FIG. 2 after being cut away.

Figure 3:
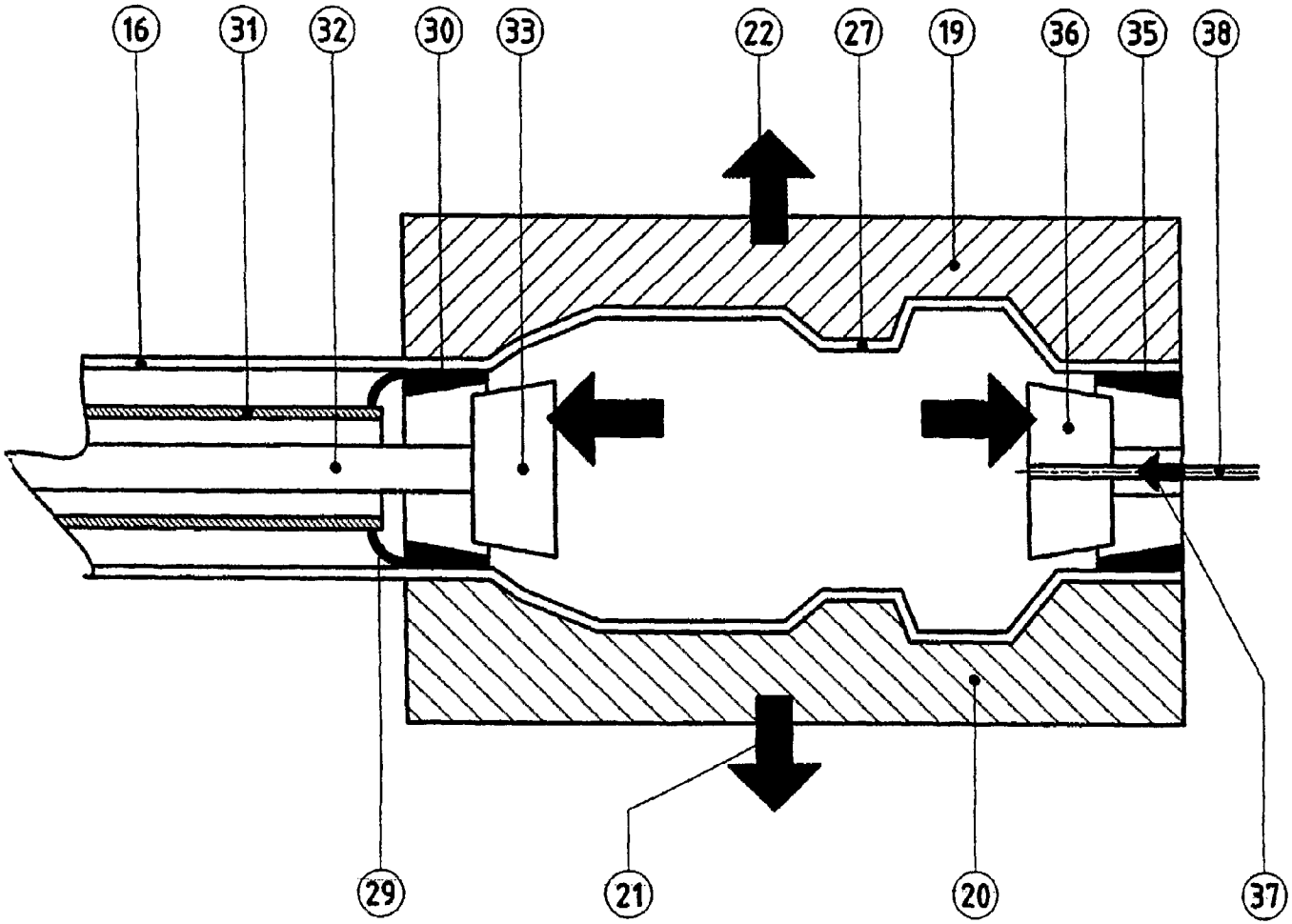
FIG. 3 shows an enlargement of a part that is shown in the preceding drawings.

The hydroforming process is best described with reference to FIG. 3, which shows a closed mould 19, 20 with a newly formed product 27. A conical steel ring 30 is located at the inlet side of the mould that fits together with the inner wall of the tube 16 and that is fixed in an axial direction while having a certain amount of elasticity in a radial direction, mounted on a holder with the form of a tube 31 with spokes 29. The steel ring 30 allows the tube to glide in through the ring during manufacture of the tube, and the spokes 29 allow the ring to expand. A rod 32 extends in through the tube 31 and the steel ring 30, and this rod carries a conical plug 33, which may be made of steel. As FIG. 1 makes clear, a holder 34 is located where the tube 16 has not yet been welded closed, such that the holder can support the tube 34 and the rod 32. The roll-forming unit thus has its final shaping location after the holder in order to close the tube profile 16, although this final shaping location is not shown in the figures.

A conical steel ring 35 and a conical plug 36 are located also at the other end of the mould 19, 20. The plug 36 is attached to a rod 37, and a supply channel 38 for pressure medium extends through the rod and the plug. The plug 36 and the steel ring 35 are supported by an arm 39 that can be pivoted around an axis I, as is shown in FIG. 2. The arm 39 is not displayed in FIGS. 1 and 3. It supports the ring 35 in the same manner as the tube 31 supports the ring 30. The arrangement that is formed by the items 35-39 is shown in FIG. 2 with the plug and steel ring pivoted into the end of the tube 16. The dashed lines show the arrangement 35-39 when it is pivoted away. It is possible as an alternative to supply pressure medium through the other conical plug 33.

In order to place the tube 16 under pressure while it is in the mould 19, 20, the rods are drawn outwards by a power unit such that the plugs 33, 36 reach an initial position at which they form a seal with the rings 30, 35 and at which they elastically expand the rings to an initial position at which they make a seal with the tube 16. It is an advantage if the rings expand to form a seal since this minimizes leakage and provides initial friction against the tube 16, but this is not absolutely necessary. The pressure medium is supplied through the channel 38 and the pressure of the medium provides an outwards force on the plugs 33, 36 that interact with the rings in an expansive direction such that they obtain an increased normal force onto the tube 16, which is radially supported against the mould 19, 20. The spokes 29 allow this expansion of the ring 30, and the ring 35 is expanded in the same manner. Self-locking of the end-seals is obtained in this way, and it is not necessary to apply as great an external axial force in order to obtain a seal. The arrangements for sealing the ends are thus small, simple and cheap, and they simplify the construction of the production line. The machine-operated arrangements for controlling the rods 32, 34 are not shown. When the pressure is released and the plugs 33, 36 are displaced inwards by the rods 32, 37, the rings 30, 35 shrink elastically and the unit 35-39 can be pivoted out to the position shown by dashed lines in FIG. 1. The mould 19, 20 can now be opened again, and the roll-forming unit can again push the tube 16 into the mould and push the formed product out from the mould.

The plugs 33, 36 and the rings 30, 35 are both shown as having conical form. It may, however, be sufficient with either the ring or the plug having a conical form, although the illustrated embodiment is preferred.

A suspension of oil and water may be used as pressure medium in the conventional manner.

It will be understood that the manufacturing process provides a simple opportunity for complete automation from unrolling of the steel strip to removal of the completed hydrostatically formed product.

Both the roll-forming and the hydroforming are established technology and are therefore not described in more detail. It is not necessary that the roll-formed tube have a circular cross-section; it can have any cross-section. Nor does it need to have a cross-section that is constant along its length, on the condition that the available roll-forming unit can shape such tubes.

The invention claimed is:

1. A production line for the manufacture of a product through hydroforming, said production line comprising:

a decoiler (11) for unrolling a steel strip (12) from a coil (13)

a roll-forming unit (14) for folding the steel strip into a tube (16), a welding unit (17) for welding together edges of the steel strip, a hydroforming unit (18) comprising a mold (19, 20) movable between opened and closed positions to receive in said opened position a completed tube as the tube is being formed and welded, a cutting arrangement (24, 25) for cutting off a completed product (23) that has been removed from the hydroforming unit, sealing arrangements (30-33; 35-39) at two ends of the mold to seal the tube, and a line (38) for the supply of pressure medium through one of the sealing arrangements to place the tube under pressure.

2. The production line according to claim 1, wherein each of the sealing arrangements (30-33); 35-39) comprises a ring (30, 35) with a thin wall that fits into an inner surface of the tube (16), a plug (33, 36) displaceable in an axial direction mounted axially inside of the ring, at least one of the ring and the plug having a conical form such that the plug and the ring together form a seal that is self-locking inside of the tube (16).

3. The production line according to claim 2, further including an arrangement (32, 37) for initially drawing the plug (33, 36) outwards relative to said mold in said closed position such that it forms a seal with the ring (30, 35) and places the ring under elastic tension outwards relative to said mold in said closed position.

4. A method for manufacturing a product through hydroforming, the sequential steps of said method comprising: unwinding a strip (12) from a roll (13), and directly forming a tube (16) by welding of said strip, introducing said tube into a mold (19, 20) for hydroforming, and holding open said mold for removing therefrom a previously shaped product, stopping the unwinding of the strip when the previously shaped product has been removed, closing the mold sealing both ends of the tube and placing the tube under sufficient pressure such that it is shaped into a product, opening the mold, recommencing manufacture of the tube, stopping the unwinding of the strip, cutting away a completed product, and hydroforming a new product.

* * * * *